US006263988B1

(12) United States Patent
Matatof

(10) Patent No.: US 6,263,988 B1
(45) Date of Patent: Jul. 24, 2001

(54) DOWNHOLE DRILL SYSTEM AND DE-COUPLING ASSEMBLY

(76) Inventor: Jacob Matatof, 4420 NW. 100th Ave., Coral Springs, FL (US) 33065

( * ) Notice: Subject to any disclaimer, the term of this patent is extended or adjusted under 35 U.S.C. 154(b) by 0 days.

(21) Appl. No.: 09/174,614

(22) Filed: Oct. 19, 1998

(51) Int. Cl.[7] ..... E21B 17/02
(52) U.S. Cl. ..... 175/320
(58) Field of Search ..... 175/320; 166/242.6; 411/2, 3, 5, 9, 10, 11, 532, 539, 531; 403/16; 285/92, 2, 3, 4

(56) References Cited

U.S. PATENT DOCUMENTS 1,324,036 * 12/1919 DeLaval ..... 285/2
3,236,543 * 2/1966 Mueller ..... 285/2
3,502,353 * 3/1970 Burns ..... 285/2
4,064,953 * 12/1977 Collins ..... 175/321
4,424,988 * 1/1984 Cowx ..... 285/2
4,501,287 * 2/1985 Thomson ..... 285/3
4,658,915 * 4/1987 Goris et al. ..... 175/57

* cited by examiner

*Primary Examiner*—Thomas B. Will
*Assistant Examiner*—Kristine M. Markovich
(74) *Attorney, Agent, or Firm*—Malloy & Malloy, P.A.

(57) ABSTRACT

A downhole drill system including a primary drive shaft with a drill head coupled to a distal end of the primary drive and a drill head de-coupling assembly disposed therebetween. The drill head de-coupling assembly includes a ring shaped spacer assembly, positioned between the primary drive shaft and the drill head so as to maintain a gap therebetween subsequent to tightened coupling between the primary drive shaft and the drill head, and subsequent to extend use of the drill head, and a retention assembly structured to maintain the spacer assembly between the primary drive shaft and the drill head until affirmatively released thereby so as to permit removal of the spacer assembly from between the primary drive shaft and the drill head, leaving only the gap between the primary drive shaft and the drill head, and thereby facilitating removal of the drill head from the primary drive shaft subsequent to the extended use of the drill head.

22 Claims, 2 Drawing Sheets

DOWNHOLE DRILL SYSTEM AND DE-COUPLING ASSEMBLY

BACKGROUND OF THE INVENTION

1. Field of the Invention

The present invention relates to a downhole drill system and de-coupling assembly utilized primarily in a heavy duty industrial setting so as to drive a hole into various types of solid, underlying terrain, the de-coupling assembly being structured to facilitate removal and interchanging of a drill head from the drill system after an extended period of use, which normally results in a severe tightening of the drill head onto a primary drive shaft, without requiring the use of substantially high strength, heavy duty machinery in order to achieve the rapid and effective disengagement of the drill head during continuing use of the downhole drill system itself.

2. Description of the Related Art

Downhole drill systems are a common type of heavy duty machinery used in a variety of industrial settings. In particular, the downhole drill systems are typically structured to drive generally straight, vertical holes into a solid underlying terrain, such as solid rock or stone. The downhole drill system typically operates with a drive shaft and a drill head coupled at a distal end thereof, typically by a threaded connection. In use, the drive shaft is repeatedly driven downwardly into impacting engagement with the underlying terrain such that the drill head effectively drives a hole into the terrain. Naturally, the dimensions of the drive shaft and the drill head dictate the size of the hole and can vary greatly depending upon the ultimately desired dimensions of the hole to be made. Also, because in many instances variations in the size of the hole is desired, such as an increase from a smaller diameter hole to a larger diameter hole in particularly hard terrain, and because of the expense of the heavy duty equipment, it is often desirable to achieve a certain degree of interchangeability of the drill head dimensions, while utilizing the same drive shaft.

Unfortunately, a primary difficulty associated with the use of downhole drill systems relates to that necessary interchanging of the drill head, both during and after use of the system. For example, drill heads may become dirty, or broken, or may require interchanging due to dimensional modifications, and therefore must be removed from the drive shaft. Because, however, of the substantial impacts to which the drill system is subjected, the drill head normally becomes increasingly tightened and secured to the drive shaft as prolonged use continues. As a result, when interchanging of the drill head is required and de-coupling by unthreading must be effectuated, substantial problems can arise if the drill head is on too tight.

Despite the need to achieve effective de-coupling, presently in the art, no system has been developed which achieves a cost effective, rapid and/or truly functional decoupling of the drill head. Specifically, the presently available techniques utilize substantially heavy equipment to gradually unthread the drill head from the drive shaft by using pure force to unthread the drill head. Because of the severe tightened engagement that results from the repeated impacts by the drill system, however, even using the heavy duty de-coupling machinery the entire de-coupling procedure can be substantially costly, difficult and time consuming. As a result, users of downhole drill systems are typically required to utilize a plurality of drive shafts, such that when interchanging of a drill head is required, normal operation with a second drive shaft can continue while the drill head is being removed over an extended period of time.

Accordingly, based on the proceeding it would be substantially beneficial to provide a downhole drill system and drill head de-coupling assembly which does not hinder the normal effective operation of the downhole drill system, but which effectively permits the removal of the drill head from the primary drive shaft after it has been used for an extended period of time. Such a de-coupling assembly should be substantially cost effective and convenient to utilize in virtually every downhole drill situation, and it should be resistant to the natural tendency of the drill head to become further tightened on the drive shaft. Indeed, such a decoupling assembly would save substantial time, effort and money by permitting rapid and effective removal of drill heads from the drive shaft, and thereby eliminate the requirement for various drive shafts at each particular job site, and minimizing the down time that may normally be associated with drill head interchanging. Moreover, an improved system should not require extended manipulation by high strength un-screwing equipment.

SUMMARY OF THE INVENTION

The present invention is directed towards a downhole drill system utilized to drive a hole of a desired diameter in underlying, solid terrain. As such, the downhole drill system includes a primary drive shaft and a drill head. The drill head is structured to be coupled to a distal end of the primary drive shaft, such as through a threaded engagement. In particular, the threaded engagement is structured to permit removability of the drill head.

Further included with the downhole drill system of the present invention, so as to facilitate the removal and interchangeability of the drill head, is a drill head de-coupling assembly. The drill head de-coupling assembly of the present invention includes primarily a spacer assembly. The spacer assembly is structured to be disposed between the primary drive shaft and the drill head, preferably in generally surrounding or peripheral relation to the typical threaded coupling structure that extends between the drill head and the primary drive shaft. As a result, upon tightening of the primary drive shaft with the drill head, the spacer assembly functions to remain in place and maintain a gap therebetween. Moreover, the spacer assembly is structured to maintain that gap, thereby generally preventing complete tightening between the primary drive shaft and the drill head, during and subsequent to the extended use of the drill. In particular, because of the downward pressure being exerted by the downhole drill system, the continued use thereof typically results in the drill head becoming more and more tightened onto the primary drive shaft. The spacer assembly of the present invention is interposed between the primary drive shaft and the drill head so as to maintain that gap and thereby limit how tight the system can become.

Further included with the drill head of the coupling assembly is a retention assembly. In particular, the retention assembly is structured to maintain the spacer assembly between the primary drive shaft and the drill head during that extended use of the drill head. The retention assembly, however, is also structured to selectively release the spacer assembly from its position between the primary drive shaft and the drill head when desired by a user, such as subsequent to the extended use and when removal of the drill head is required. Along these lines, the spacer assembly, while being structured to maintain the gap between the primary drive shaft and the drill head is also structured to be removable from therebetween upon it being released by the retention assembly. As a result, when removal of the drill head is desired, the retention assembly can be manipulated to release the spacer assembly, thereby permitting the spacer assembly to be removed from between the primary drive shaft and the drill head leaving the gap between the primary drive shaft and the drill head. Typically, that gap between the primary drive shaft and the drill head is sufficient to have prevented maximum tightening therebetween and as a result relatively facilitated removal of the drill head from the primary drive shaft can be accomplished, even after the extended use of the drill head.

It is an object of the present invention to provide a downhole drill system which is effective for forming holes of varying diameters in solid terrain, but which is also configured so as to achieve relatively facilitated interchanging of the drill head.

A further object of the present invention is to provide a drill head de-coupling assembly which is substantially cost effective to implement in order to significantly increase the removability of a drill head from a downhole drill system.

Yet another object of the present invention is to provide a drill head de-coupling assembly capable of withstanding the substantial impacts associated with a downhole drilling system, while maintaining its necessary integrity during use of the downhole drill system in order to facilitate removal of the drill head subsequent to use of the drill system.

Also another object of the present invention is to provide a drill head de-coupling assembly which is substantially easy to remove from between a drill head and a primary drive shaft after use of the system, without the need to implement expensive tools and/or difficult and time consuming procedures.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
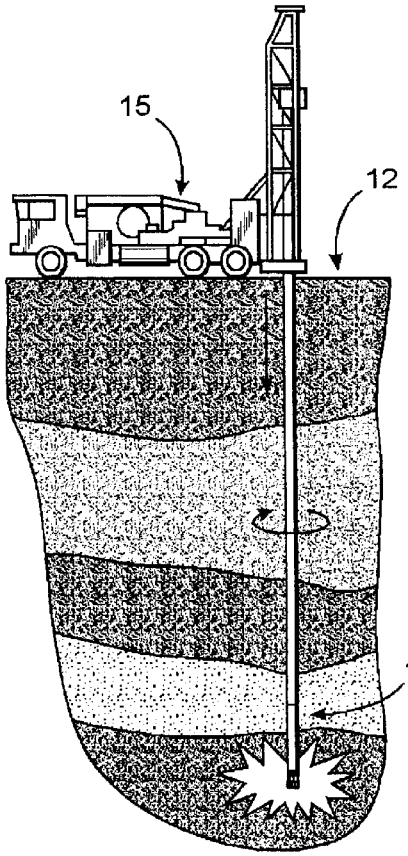
FIG. 1 is a perspective view of the downhole drill system of the present invention in use.
Figure 2:
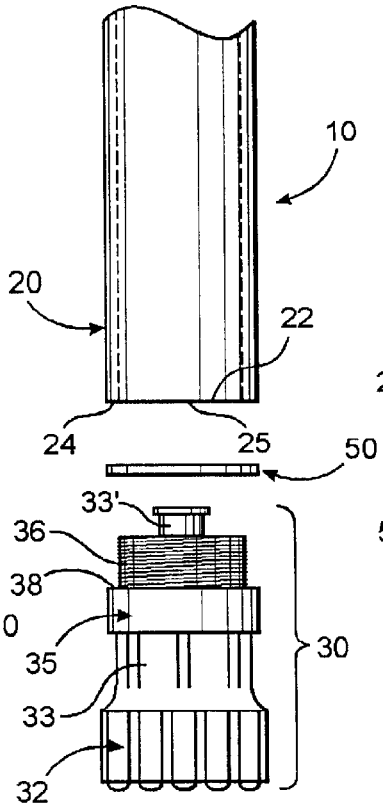
FIG. 2 is an isolated exploded view of the downhole drill system of the present invention.
Figure 3:
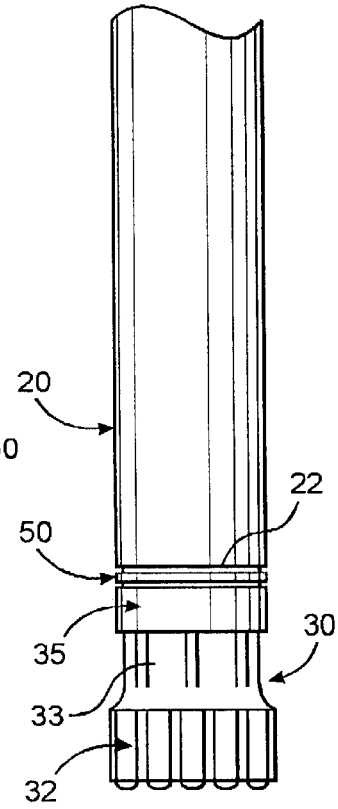
FIG. 3 is an isolated assembled view of the downhole drill system of the present invention.

Shown throughout the Figures, the present invention is directed towards a downhole drill system, generally indicated as 10, and a preferably associated de-coupling assembly, generally indicated as 50. In particular, the downhole drill system 10 of the present invention is preferably structured to be utilized with a pile driver type assembly 15 so as to be repeatedly driven into underlying terrain 12 and thereby form a generally straight hole, to substantial depths within the underlying terrain 12. As illustrated in FIG. 1, the downhole drill system 10 as referred to herein is typically a shorter, adjustably sized segment disposed at the end of an elongate driving assembly, depending upon the depth to which the drilling is to be achieved by the downhole drill system 10. Of course, the overall structure, including the pile driver or other downward force applying machinery, could be included as part of the downhole drill system.

The downhole drill system 10 of the present invention includes two primary sections, namely a primary drive shaft, generally 20, and a drill head, generally 30. The primary drive shaft 20 is typically of an elongated, tubular configuration, and is formed of a strong, rigid material so as to withstand repeated impact and torque. Defined at a distal end 22 of the primary drive shaft 20, is preferably an at least partially open bore 25 at which the drill head 30 is coupled.

Looking to the drill head 30, it preferably includes a hammer portion 32 and a hub portion 35. Specifically, the hammer portion 32 includes a tapered shaft 33 that is structured to extend through an opening 37 defined in the hub portion 35. As a result, the hammer portion 32 can in some instances be removed from the hub portion 35. More importantly, however, the hub portion 35 of the preferred embodiment includes a threaded segment 36 that is structured to be engaged within the bore 25 of the primary drive shaft 20. The interior of the bore 25 of the primary drive shaft 20 is accordingly preferably of a threaded configuration and as a result the drill head 30 can be threaded into the primary drive shaft 20 therein. It is noted that although the above threaded interconnection is preferred, other modes of removable interconnection may be achieved. Furthermore, the primary drive shaft could be configured with a segment that extends into the drill head or a separate threaded connector shaft may be disposed to engage an interior threaded configuration in both the primary drive shaft and the drill head.

The removable and preferably threaded engagement between the drill head 30 and the primary drive shaft 20 is structured to permit the interchangeability of drill head 30 so as to accommodate varying sized holes and/or to continue work if the hammer portion 32 becomes damage. Still another advantage to the use of the hub portion 35 is an overall longer life of the drill head since the hammer portion 32 is susceptible to repeated impacts and a direct threaded engagement of the hammer 10, portion 32 with the primary drive shaft 20 would result in excessive force being applied across the face of the threads such that they would break or excessively wear. Utilizing the present configuration, as the hammer portion 32 engages the underlying surface, and indeed is twisted to a certain extent, it is driven more and more into the hub portion 35. Of course, for this reason the hammer portion 32 and the hub portion 35 typically comprise a single drill head 30, often interchanged as a single unit, and indeed can be configured of a unitary or integral construction if desired.

Despite the intended interchangeability between the drill head 30 and the primary drive shaft 20, after repeated impacts by the drill head 30 with the underlying terrain 12, the threaded engagement between the hub portion 35 of the drill head 30 and the primary drive shaft 20 continuously tightens. As a result, after an extended period of use it can become substantially difficult to remove the drill head 30 from the primary drive shaft 20. This can be a substantial drawback if interchangeability of the drill head 30 is desired for continued work at a particular job site. As a result, the downhole drill system 10 of the present invention also preferably incorporates a de-coupling assembly 50. The de-coupling assembly 50 is structured to be disposed between the drill head 30 and the primary drive shaft 20 so as to facilitate de-coupling therebetween, when ever desired. In the preferred embodiment, this facilitated de-coupling is achieved by interposing at least a portion of the de-coupling assembly 50 between the drill head 30, especially at the hub portion 35, and the primary drive shaft 20.

Looking to the preferred embodiment of the de-coupling assembly 50, it preferably includes a ring like configuration with an aperture 57, and is structured to be fitted over the threaded portion 36 of the drill head 30, or merely positioned between the primary drive shaft 20 and the drill head 30 if alternative engagement therebetween is realized. Preferably, the aperture 57 of the preferred de-coupling assembly 50 is specifically sized to receive the protruding threaded portion 36 therethrough, and to engage the engaging peripheral face, or flange 38 formed on the hub portion 35 of the drill head 30. In particular, the engaging peripheral face 38 of the drill head 30 is structured to generally abut an engaging peripheral face 24 of the primary drive shaft 20, at its distal end 22, absent the inter position of the de-coupling assembly 50. Typically, the spacing between the engaging peripheral faces 24 and 38 is continuously decreased as the drill head is continuously used to make a corresponding hole, thereby resulting in increased tightening. By positioning the de-coupling assembly 50 therebetween, a gap is maintained and the maximum, absolute tightening therebetween is not achieved.

The de-coupling assembly 50 of the present invention includes primarily a spacer assembly 55. The spacer assembly 55 is structured to be disposed between the primary drive shaft 20 and the drill head 30, such as at the engaging peripheral faces 24 and 38 thereof, thereby maintaining the gap therebetween and functioning to permit de-coupling between the primary drive shaft 20 and the drill head 30 subsequent to extended use of the drill head 30. In the preferred embodiment of FIG. 5, the spacer assembly 55 includes at least two but preferably three spacer segments 55' disposed in close engagement with one another so as to define the preferred ring like shape of the spacer assembly 55. Along these lines it is understood that the spacer segments 55' may be spaced apart from one another so long as a sufficient surface area thereof is disposed between the drill head 30 and the primary drive shaft 20 to maintain the gap therebetween. Moreover, any desired number of spacer segments 55' can be used to define the overall spacer assembly 55.

The de-coupling assembly 50 further includes a retention assembly. The retention assembly is operatively associated with the spacer assembly 55 so as to generally maintain the spacer assembly 55 properly disposed between the primary drive shaft 20 and the drill head 30 during the extended use of the drill head. Moreover, the retention assembly is specifically structured so as to be selectively released or disengaged by the user, thereby releasing the spacer assembly 55 from its retained position between the primary drive 20 and the drill head 30. Along these lines, the spacer assembly 55 is specifically structured to be removable from between the primary drive shaft 20 and the drill head 30 once it is released by the retention assembly, thereby leaving the gap between the primary drive shaft 20 and drill head 30 and facilitating removal of the drill head 30 from the primary drive shaft 20 subsequent to the extended use of the drill head 30. As discussed, during use, the drill head 30 and primary shaft 20 tend to tighten towards one another, but with the spacer assembly 55 of the de-coupling assembly 50 disposed therebetween, the drill head 30 and primary drive shaft 20 do not tighten against one another, but rather tighten against the spacer assembly 55. By providing for a removable structure of the spacer assembly 55, once work with a particular drill head 30 is completed, the downhole drill system 10 of the present invention is removed from the hole, and the retention assembly is manipulated such that the spacer assembly 55 is released. At that point, the spacer assembly 55 can be removed from the between the drill head 30 and the primary drive shaft 20 and a relatively loose engagement between the drill head 30 and primary drive shaft 20 remains.

Figure 4:
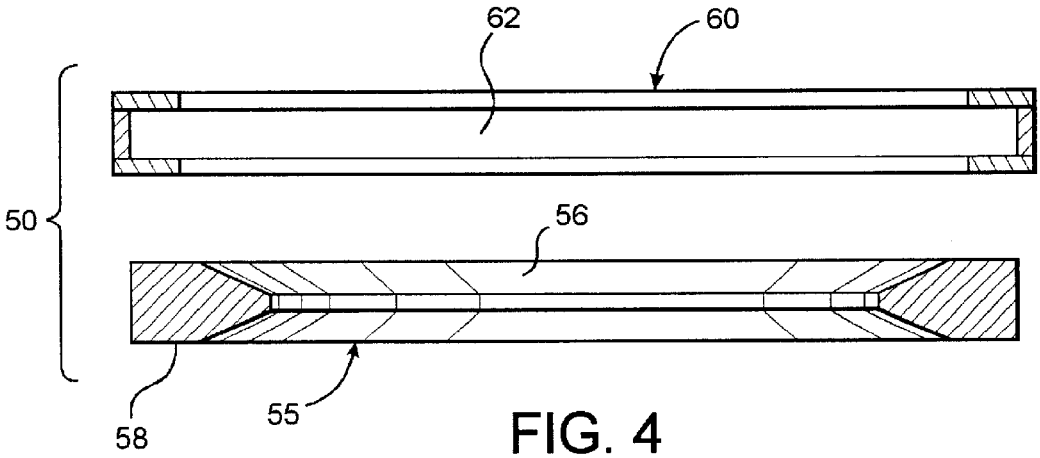
FIG. 4 is an exploded, cross section of the de-coupling assembly of the present invention.
Figure 5:
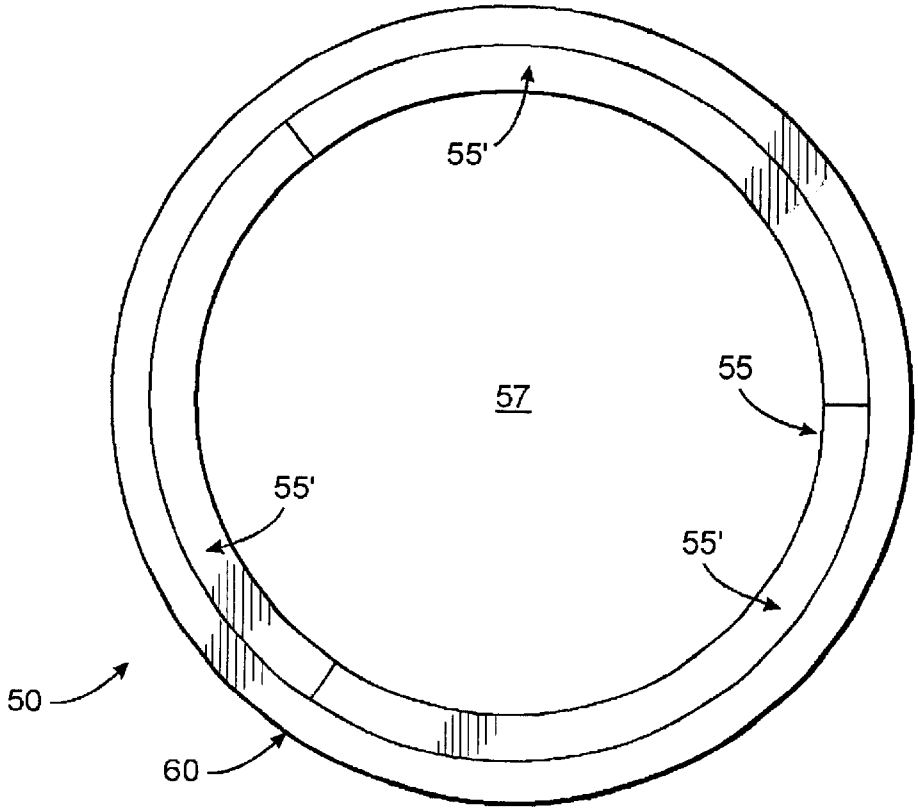
FIG. 5 is a top plan view of a preferred embodiment of the de-coupling assembly of the present invention.

Returning once again to the preferred embodiment of the de-coupling assembly 50, illustrated in FIG. 5, the retention assembly preferably comprises a collar assembly 60 that is disposed about the spacer assembly 55. The collar assembly 60 as illustrated in FIGS. 4 and 5, includes a preferably C-shaped configuration including an interior channel 62 wherein a base 58 of the spacer assembly 55 is retained. The collar assembly 60, which defines the preferred retention assembly, preferably does not completely enclose the spacer assembly 55, but rather an interior portion 56 of the spacer assembly 55 preferably protrudes inwardly from the collar assembly 60 and is the portion of the spacer assembly 55 that is actually sandwiched between the engaging peripheral faces 24 and 38 of the primary drive shaft 20 and drill head 30. Although it is conceivable that this preferred embodiment of the retention assembly, namely the collar assembly 60 could include a variety of configurations, including an integral or segmented latch, clasp or other release structure, in the preferred embodiment the collar assembly 60 includes a unitary construction formed of a relatively thin, yet strong material. In this embodiment, the collar assembly 60 is structured to retain the spacer segments 55' of the spacer assembly 55 until affirmative release thereof is desired. Further, the relatively thin construction of the collar assembly 60 is preferable such that a user, utilizing a chisel or other device can split the collar assembly 60 at any point desired, causing the collar assembly 60 to be detached from its retaining relation about the spacer segment 55. Once the collar assembly 60 is detached and removed from about the spacer segments 55', the spacer assembly 55 can then be removed from between the primary drive shaft 20 and drill head 30. As to other potential embodiments of the collar assembly 60, a release mechanism, screw, clip, tie or a special notch configuration can be provided so as to define a point of detachment, with the primary function of the retention assembly being to retain the spacer segment(s) 55' in position between the primary drive shaft 20 and the drill head 30 until affirmatively released. Also, the collar assembly 60 may also include a series of sections or clamp type structures disposed at each of the adjoining faces between adjacent spacer segments 55'.

Figure 6:
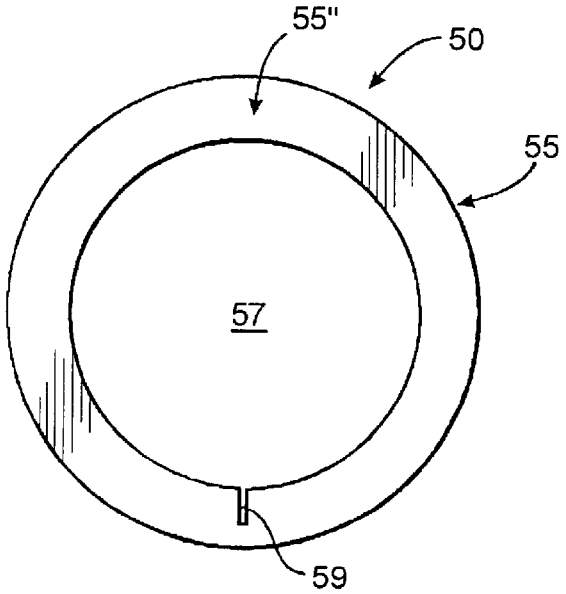
FIG. 6 is a top plan view of an alternative embodiment of the de-coupling assembly of the present invention.

Looking to the embodiment of FIG. 6, it is also contemplated that the spacer assembly 55 may include a single spacer segment 55". This single spacer segment 55" may be integrally defined so as to maintain its generally ring shaped configuration and disposition between the primary drive shaft 20 and the drill head 30 without a separate collar assembly 60 to act as the retention assembly. In this embodiment, a unitary integral construction of the spacer assembly 55, preferably at the base 58, defines the retention assembly. As a result, a release of the retention assembly will comprise a break in the integral construction of the unitary spacer segment 55", causing a release of the spacer assembly 55 and facilitating removal of the spacer assembly 55 from between the primary drive shaft 20 and the drill head 30. In this embodiment, a notch or partially severed groove 59 may be formed in the integral spacer segment 55". This notch or groove 59 should not be so large as to substantially compromise the integrity of the unitary spacer 55" during use of the downhole drill system 10, however, along with a possible guide marker, such as a groove or indicia, it can provide more facilitated visibility of an optimal point to sever the spacer assembly 55 when removal of the drill head 30 is desired.

Figure 7:
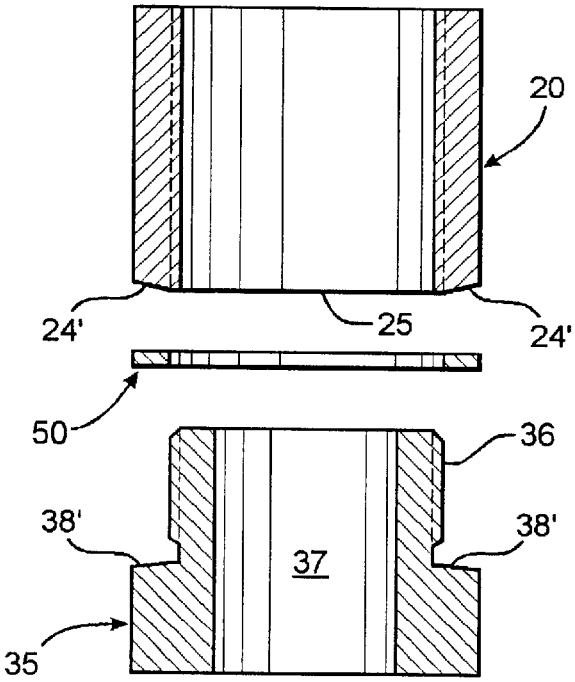
FIG. 7 is an exploded, cross section of the downhole drill system of the present invention.

Turning to FIGS. 4 and 7 in a most preferred embodiment of the present invention, the interior portion 56 of the spacer assembly 55 preferably includes an at least partially inwardly tapered configuration. This inwardly tapered configuration is structured such that subsequent tightening between the primary drive shaft 20 and drill head 30 will tend to squeeze or urge the spacer assembly 55 out from between the primary drive shaft 20 and drill head 30. As a result, upon release of the spacer assembly 55 by detachment of the retention assembly, the squeezing that results from the tightened engagement of the drill head 30 and primary drive shaft 20 against the spacer assembly 55 normally tends to push the spacer assembly 55 out from therebetween such that only the gap remains and removal of the drill head 30 can be achieved. Furthermore, as illustrated in FIG. 7, the engaging surfaces 24' and 38' which define the engaging peripheral faces of the primary drive shaft 20 and the drill head 30 are also preferable inwardly tapered. As a result, the mating tapered surfaces further function to urge the spacer assembly 55 from between the primary drive shaft 20 and the drill head 30 upon release thereof by detachment of the retention assembly.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A downhole drill system comprising:

a) a primary drive shaft, said primary drive shaft including a distal end;

b) a drill head, said drill head structured to be coupled to said primary drive shaft at said distal end;

c) a drill head de-coupling assembly, said drill head de-coupling assembly comprising:

a spacer assembly, said spacer assembly being structured to be disposed between said primary drive shaft and said drill head so as to maintain a gap therebetween subsequent to tightened coupling between said primary drive shaft and said drill head, and subsequent to extended use of said drill head, a retention assembly structured to maintain said spacer assembly between said primary drive shaft and said drill head during the extended use of said drill head, said retention assembly being further structured to selectively release said spacer assembly, and said spacer assembly being structured to be removable from between said primary drive shaft and said drill head, upon being released by said retention assembly, so as to leave said gap between said primary drive shaft and said drill head, and thereby facilitate removal of said drill head from said primary drive shaft subsequent to the extended use of the drill head.

2. The downhole drill system as recited in claim 1 wherein said spacer assembly comprises at least two spacer segments, said spacer segments being retained between said primary drive shaft and said drill head by said retention assembly.

3. The downhole drill system as recited in claim 2 wherein said spacer segments comprise an at least partially inwardly tapered configuration such that tightening of said primary drive shaft and said drill head towards one another tends to urge said spacer assembly out from therebetween upon release by said retention assembly.

4. The downhole drill system as recited in claim 2 comprising three of said spacer segments disposed between said primary drive shaft and said drill head.

5. The downhole drill system as recited in claim 3 wherein said retention assembly comprises a collar assembly disposed about said spacer assembly so as to retain said spacer segments between said primary drive shaft and said drill head.

6. The downhole drill system as recited in claim 5 wherein said collar assembly is structured to be detached from its retaining relation about said spacer segments so as to facilitate removal of said spacer segments from between said primary drive shaft and said drill head.

7. The downhole drill system as recited in claim 2 wherein said retention assembly comprises a collar assembly disposed about said spacer assembly so as to retain said spacer assembly between said primary drive shaft and said drill head.

8. The downhole drill system as recited in claim 1 wherein said retention assembly is defined by a unitary integral construction of said spacer assembly, and release of said retention assembly comprises a break in said integral construction of said spacer assembly such that said spacer assembly is urged from between said primary drive shaft and said drill head.

9. The downhole drill system as recited in claim 8 wherein said spacer assembly comprises an at least partially inwardly tapered configuration such that tightening of said primary drive shaft and said drill head towards one another tends to urge said spacer assembly out from therebetween absent said retention assembly.

10. The downhole drill system as recited in claim 1 wherein said spacer assembly comprises an at least partially inwardly tapered configuration such that tightening of said primary drive shaft and said drill head towards one another tends to urge said spacer assembly out from therebetween absent said retention assembly.

11. The downhole drill system as recited in claim 10 wherein engaging peripheral faces of said primary drive shaft and said drill head between which said spacer assembly is disposed are inwardly tapered so as to tend to urge said spacer assembly out from therebetween absent said retention assembly.

12. A de-coupling assembly comprising:

a spacer assembly, said spacer assembly being structured to be disposed between a pair of engaging surfaces so as to maintain a gap therebetween, a retention assembly structured to maintain said spacer assembly between said engaging surfaces subsequent to tightening of said engaging surfaces towards one another, said retention assembly being further structured to selectively release said spacer assembly, said spacer assembly being structured to be removable from between said engaging surfaces, upon being released by said retention assembly, so as to leave said gap between said engaging surfaces, and thereby facilitate de-coupling therebetween, and said engaging surfaces including engaging peripheral faces of a primary drive shaft and a drill head.

13. The de-coupling assembly as recited in claim 12 wherein said spacer assembly comprises at least two spacer segments, said spacer segments being retained between said engaging surfaces by said retention assembly.

14. The de-coupling assembly as recited in claim 13 wherein said spacer segments comprise an at least partially inwardly tapered configuration such that tightening of said engaging surfaces towards one another tends to urge said spacer assembly out from therebetween upon release by said retention assembly.

15. The de-coupling assembly as recited in claim 13 comprising three of said spacer segments disposed between said engaging surfaces.

16. The de-coupling assembly as recited in claim 14 wherein said retention assembly comprises a collar assembly disposed about said spacer assembly so as to retain said spacer segments between said engaging surfaces.

17. The de-coupling assembly as recited in claim 16 wherein said collar assembly is structured to be detached from its retaining relation about said spacer segments so as to facilitate removal of said spacer segments from between said engaging surfaces.

18. The de-coupling assembly as recited in claim 13 wherein said retention assembly comprises a collar assembly disposed about said spacer assembly so as to retain said spacer assembly between said engaging surfaces.

19. The de-coupling assembly as recited in claim 12 wherein said retention assembly is defined by a unitary integral construction of said spacer assembly, and release of said retention assembly comprises a break in said integral construction of said spacer assembly such that said spacer assembly is urged from between said engaging surfaces.

20. The de-coupling assembly as recited in claim 19 wherein said spacer assembly comprises an at least partially inwardly tapered configuration such that tightening of said engaging surfaces towards one another tends to urge said spacer assembly out from therebetween absent said retention assembly.

21. The de-coupling assembly as recited in claim 12 wherein said spacer assembly comprises an at least partially inwardly tapered configuration such that tightening of said engaging surfaces towards one another tends to urge said spacer assembly out from therebetween absent said retention assembly.

22. A de-coupling assembly comprising:

a spacer assembly, said spacer assembly being structured to be disposed between a pair of engaging surfaces so as to maintain a gap therebetween, a retention assembly structured to maintain said spacer assembly between said engaging surfaces subsequent to tightening of said engaging surfaces towards one another, said retention assembly being further structured to selectively release said spacer assembly, said spacer assembly being structured to be removable from between said engaging surfaces, upon being released by said retention assembly, so as to leave said gap between said engaging surfaces, and thereby facilitate de-coupling therebetween, and said spacer assembly including an at least partially inwardly tapered configuration such that tightening of said engaging surfaces towards one another tends to urge said spacer assembly out from therebetween absent said retention assembly.

* * * * *